US009131742B2

(12) United States Patent
Gowen

(10) Patent No.: US 9,131,742 B2
(45) Date of Patent: Sep. 15, 2015

(54) CHINSTRAP TO HELMET CONNECTOR

(76) Inventor: Christopher D. Gowen, Studio City (CA)

( * ) Notice: Subject to any disclaimer, the term of this patent is extended or adjusted under 35 U.S.C. 154(b) by 884 days.

(21) Appl. No.: 13/114,489

(22) Filed: May 24, 2011

(65) Prior Publication Data

US 2011/0289660 A1 Dec. 1, 2011

Related U.S. Application Data

(60) Provisional application No. 61/396,535, filed on May 27, 2010.

(51) Int. Cl.
*A42B 3/08* (2006.01)

(52) U.S. Cl.
CPC ..... *A42B 3/08* (2013.01)

(58) Field of Classification Search
CPC ..... A44B 11/006; A42B 3/08
USPC ..... 2/6.2, 421, 422, 425; 24/265 BC, 24/265 EC, 633, 636, 640
See application file for complete search history.

(56) References Cited

U.S. PATENT DOCUMENTS

| | | | | | |
|---|---|---|---|---|---|
| 968,036 | A | * | 8/1910 | Erickson | 24/633 |
| 1,308,545 | A | * | 7/1919 | Humphrey | 24/633 |
| 1,425,525 | A | | 8/1922 | Hollick | |
| 1,649,071 | A | | 11/1927 | Lowe | |
| 1,820,323 | A | * | 8/1931 | Powell | 24/633 |
| 2,597,857 | A | | 5/1952 | Francesco | |
| 3,984,191 | A | | 10/1976 | Doty | |
| 3,990,113 | A | | 11/1976 | Coenen | |
| 4,110,847 | A | | 9/1978 | Dera | |
| 4,375,281 | A | | 3/1983 | Nichols | |
| 4,697,968 | A | | 10/1987 | Veronesi | |
| 4,716,631 | A | | 1/1988 | Gay | |
| 5,452,979 | A | | 9/1995 | Cosenza | |
| 5,894,641 | A | * | 4/1999 | Hurtz et al. | 24/658 |
| 6,032,339 | A | * | 3/2000 | D'Addario | 24/649 |
| 6,205,629 | B1 | * | 3/2001 | Becker | 24/633 |
| 6,301,757 | B1 | * | 10/2001 | Kunii et al. | 24/636 |
| 6,330,736 | B1 | | 12/2001 | Cheng | |
| 6,352,383 | B1 | | 3/2002 | Ristola | |
| 6,389,661 | B1 | * | 5/2002 | Brown et al. | 24/633 |
| 6,484,376 | B1 | * | 11/2002 | Khatchadourian et al. | 24/658 |
| 7,045,694 | B2 | * | 5/2006 | Yasunori | 84/329 |
| 7,082,651 | B2 | * | 8/2006 | Ninomiya | 24/658 |
| 7,610,783 | B2 | | 11/2009 | Rudduck et al. | |

(Continued)

*Primary Examiner* — Shaun R Hurley
*Assistant Examiner* — Andrew W Sutton
(74) *Attorney, Agent, or Firm* — Christie, Parker & Hale, LLP

(57) ABSTRACT

This invention pertains to connections between helmets and chinstraps, and more particularly a connector which is securable to an end of a chinstrap, and which is readily connected to a helmet via a stud carried by the helmet, and in which removal of the connector from the stud requires that an actuator be moved out of a mechanical latching relation to the stud. A helmet assembly includes a helmet having a stud, a chinstrap having a strap, and a connector attached to the strap. The connector includes a housing and an actuator. The housing has an underside with an opening sized to receive the stud through the opening into the housing. The actuator is movable within the housing between a first position in which the actuator engages the stud to retain the connector to the helmet and a second position in which the actuator disengages the stud to release the connector from the helmet. The actuator has a gripping portion extending outside the housing for operation by the user to move the actuator between the first and second positions.

19 Claims, 11 Drawing Sheets

(56) References Cited

U.S. PATENT DOCUMENTS

| | | | | |
|---|---|---|---|---|
| 7,818,851 | B2 * | 10/2010 | Perrotta | 24/701 |
| 2005/0284282 | A1 * | 12/2005 | D'Addario et al. | 84/327 |
| 2006/0150304 | A1 * | 7/2006 | Bentz | 2/421 |
| 2010/0011548 | A1 * | 1/2010 | Rudduck et al. | 24/604 |
| 2011/0072563 | A1 | 3/2011 | Choi et al. | |
| 2011/0289660 | A1 * | 12/2011 | Gowen | 2/421 |

* cited by examiner 10
11
12
13
14
15
16
17
18
19
20
22
23
24
25
27
28
65
66
68a
68b
4
5

CHINSTRAP TO HELMET CONNECTOR

CROSS-REFERENCE TO RELATED APPLICATION(S)

This application claims priority to and the benefit of U.S. Provisional Application No. 61/396,535, filed May 27, 2010, the entire content of which is expressly incorporated herein by reference.

FIELD OF THE INVENTION

This invention pertains to connections between helmets and chinstraps, and more particularly a connector which is securable to an end of a chinstrap, and which is readily connected to a helmet via a stud carried by the helmet, and in which removal of the connector from the stud requires that an actuator be moved out of a mechanical latching relation to the stud.

BACKGROUND

The needs addressed by this invention were first noted in the context of the sport of American football. Players of that sport, from the very young to professional players, are required to wear protective helmets during play of the game to protect the players from potentially serious head injuries. The helmets are held in place on players' heads by chinstraps, the ends of which are releasably connected to the helmets by resilient stud and socket snap connectors. The studs are carried on the helmets and the sockets are carried on the straps at or adjacent the strap ends. Existing snap connectors operate by simply pushing the socket onto the stud to connect the chinstrap to the helmet, and by pulling the socket off the stud to disconnect the strap from the helmet.

The described snap connections of chinstraps to football helmets are not reliably secure. If often happens that a player's helmet is dislodged from the player's head, thus subjecting that player to a head injury during continuance of the game before a "play" is completed. Players have experienced head injuries after having helmets dislodged in the course of play. The incidence of such injuries is sufficiently high that officials, coaches, and players of American football have expressed concern. In response to such concern, it has been proposed to amend the rules of the game to require field officials (referees, umpires, judges, etc.) to stop play of the game promptly on observing that a player's helmet has become dislodged. The implementation of such a rule has the significant potential to cause a given game play to be interrupted before the play has been completed, and, as a result, to diminish the appeal of the sport to players and to spectators.

A need is seen to exist for improved devices and procedures for connecting chinstraps to helmets to reduce or eliminate the likelihood that a helmet can become unintentionally dislodged from the head of a user of the helmet. That need exists as to helmets of various kinds used in sporting and non-sporting contexts. Sporting contexts include American football as well as other sports, such as hockey, lacrosse, and other sports. Non-sporting contexts include bicyclists, motorcyclists, and law enforcement.

SUMMARY

The present invention provides mechanisms and procedures which are arranged and defined so that once a connection of a chinstrap to a helmet has been established, the connection is a latched one in which cooperating elements of the connection lock the strap to the helmet, and unlatching of the connection requires operation of a movable actuator to affirmatively unlock the connection to enable the chinstrap to be separated from the helmet. Desirable characteristics of such a connection mechanism are reliability, compactness, ease of use to secure and to release the connection, and low cost to make and to assemble the structural components of the connection.

Connection arrangements which address that need and which have those characteristics are described below with reference to the accompanying illustrations. Generally speaking, those connection arrangements are defined by cooperating parts or moieties of a connector assembly. One moiety of the connector assembly is defined by a suitably shaped projection which can be a stud, a post, or the like. The other moiety of the connector assembly is a latching receiver or housing for the projection. The receiver defines a receptacle for the projection and includes an actuator or latch mechanism which engages the projection when the projection is properly located in the receptacle. The latch mechanism secures the projection within the receiver, and it includes a manually operable actuator which, when operated, enables the projection to be removed from the receiver. The latch mechanism can be resiliently biased into engagement with the projection, so that operation of the actuator produces movement of the latch element against that bias out of engagement with the projection. The projection may be a stud carried by a helmet, and the receiver may be a housing with an actuator carried on the end of the chinstrap, such that the receiver can engage the stud to lock the chinstrap to the helmet.

In one embodiment, a helmet assembly includes a helmet having a stud, a chinstrap having a strap, and a connector attached to the strap. The connector includes a housing and an actuator. The housing has an underside with an opening sized to receive the stud through the opening into the housing. The actuator is movable within the housing between a first position in which the actuator engages the stud to retain the connector to the helmet and a second position in which the actuator disengages the stud to release the connector from the helmet. The actuator has a gripping portion extending outside the housing for operation by the user to move the actuator between the first and second positions.

In one embodiment, a helmet assembly includes a helmet, a chinstrap with a strap for securing the chinstrap to the helmet, a stud, and a connector. The stud is carried by one of the helmet or the strap, and the connector is carried by the other of the helmet or the strap. The connector includes a housing and an actuator. The housing has an opening sized to receive the stud. The actuator is movable within the housing between a first position in which the actuator engages the stud to retain the chinstrap to the helmet and a second position in which the actuator disengages the stud to release the chinstrap from the helmet. The actuator has a gripping portion extending outside of the housing, and the gripping portion is operable by the user to move the actuator with respect to the housing.

In one embodiment, a helmet assembly includes a helmet having an outer shell and a stud extending past the outer shell. The stud has an enlarged head. The helmet assembly also includes a chinstrap, and a connector attached to the chinstrap and configured to releasably attach to the stud to retain the chinstrap to the helmet. The connector includes a housing with a recess and an underside with an opening. The connector also includes an actuator movable within the recess between a first position in which the actuator engages the stud to retain the connector to the helmet and a second position in which the actuator disengages the stud to release the connector from the helmet. The actuator includes an extension that extends under the enlarged head of the stud when the actuator is in the first position, trapping the enlarged head between the extension and the housing. The actuator also includes a lug extending outside of the housing, for operation by the user, to move the actuator between the first and second positions. The stud extends outwardly from the helmet in a first plane, and movement of the actuator from the first position to the second position is in a second plane generally perpendicular to the first plane.

DETAILED DESCRIPTION

This invention pertains to connections between helmets and chinstraps, and more particularly a connector which is securable to an end of a chinstrap, and which is readily connected to a helmet via a stud carried by the helmet, and in which removal of the connector from the stud requires that an actuator or latch member be moved out of a mechanical latching relation to the stud. In one embodiment, a connector is provided to connect a chinstrap to a helmet. The connector is attached to the end of the chinstrap. The connector includes an actuator that mechanically latches to a stud on the helmet, to retain the connector and thus the chinstrap to the helmet. The actuator remains mechanically latched to the stud until the actuator is affirmatively released, by rotating, sliding, pivoting, or otherwise moving the actuator with respect to the stud. This affirmative release mechanism prevents the actuator and the connector from inadvertently releasing the stud before release is desired. As a result, the chinstrap remains securely fastened to the helmet during the user's activity, which may be a sporting event, recreational activity, law enforcement, or other activity. The chinstrap remains securely fastened, so that the helmet remains safely in place until the user affirmatively releases it.

Figure 1:
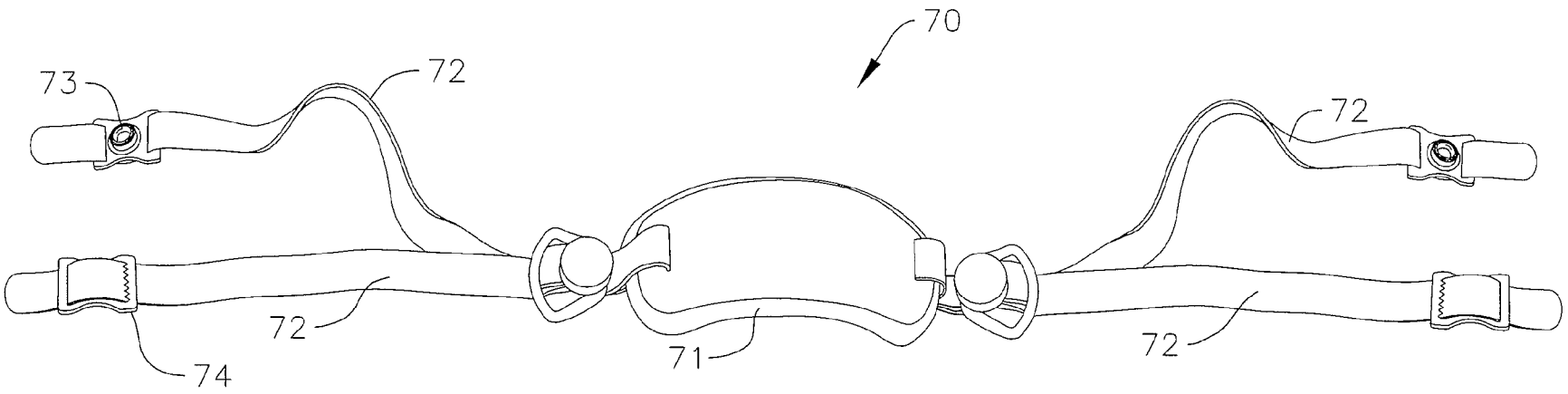
FIG. 1 is a perspective view of a football helmet chinstrap assembly.
Figure 2:
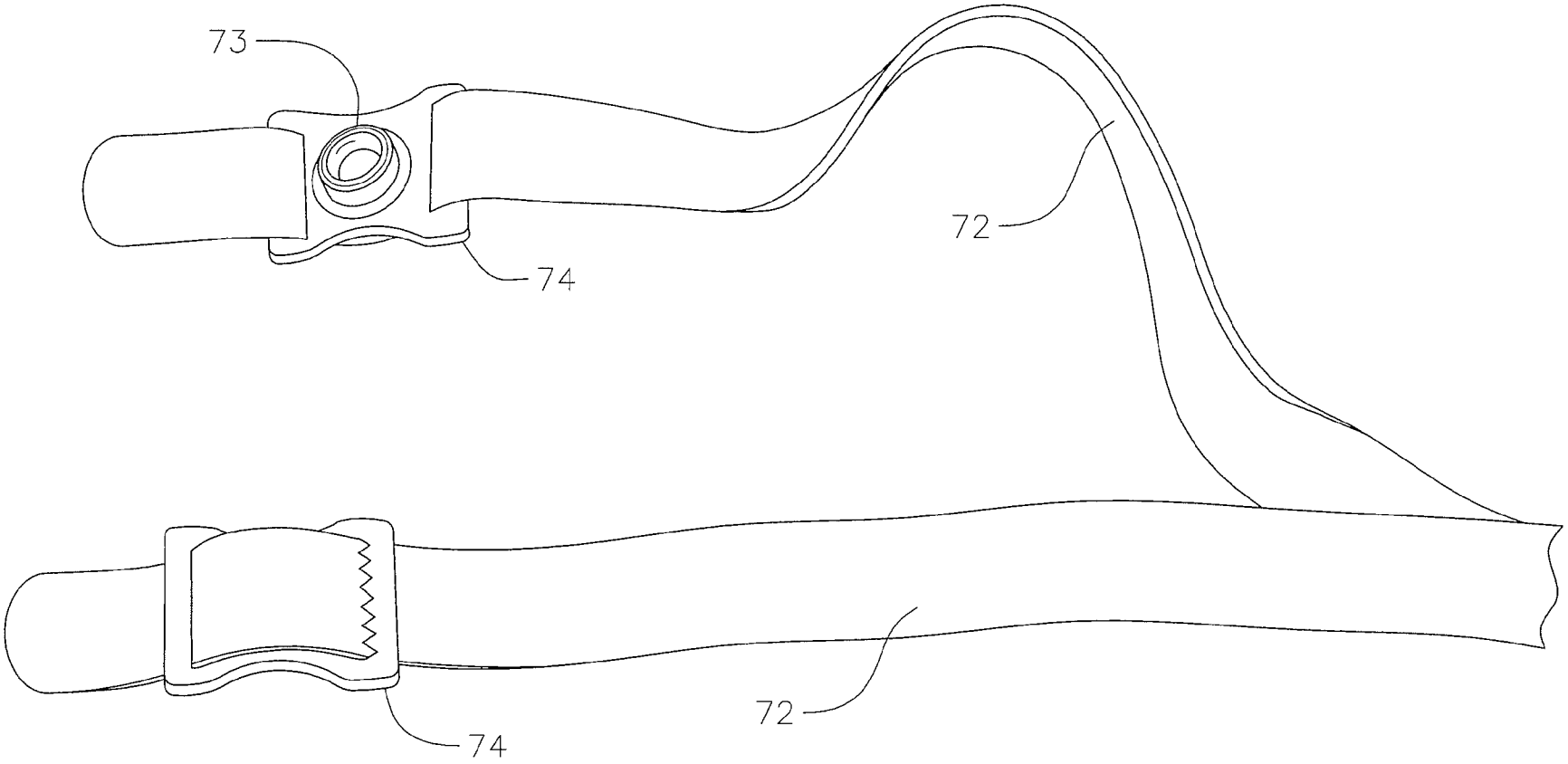
FIG. 2 is an enlarged view of the left end portion of the chinstrap assembly shown in FIG. 1.
Figure 3:
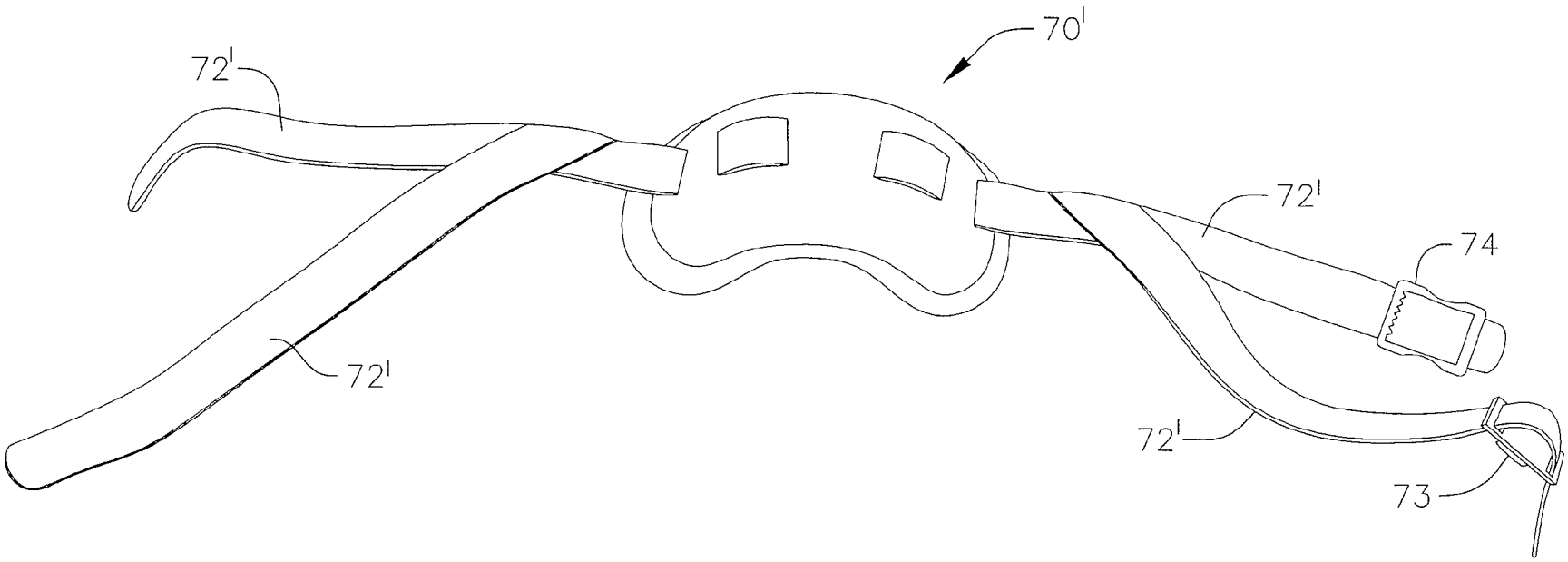
FIG. 3 is a perspective view of a football helmet chinstrap assembly.

FIG. 1 shows an existing modern chinstrap assembly 70 of the type used with modern football helmets. Assembly 70 includes a central chin cup 71 which is engaged with the point of the chin of a user; the interior of the concave side of the cup typically is padded for the comfort of the user. Left and right strap sets are connected to the corresponding ends of the chin cup. Many chinstrap assemblies commonly include two flexible straps 72 in each strap set, although each strap set may include only one strap. Each strap, at its end spaced from the chin cup, carries a conventional round snap socket 73 shown best in FIG. 2. As is well known, the snap socket is resiliently releasably engagable around the enlarged round head of a cooperating snap stud (not shown) which is secured to a football helmet and projects from the exterior of the helmet at a desired place in the cheek area of the helmet. The snap sockets 73 are secured, as by rivets, to the central portions of generally flat metal slide carriers 74. The end margins of the slide carriers define parallel slots through which a strap 72 can be passed to adjustably locate the carrier 74 and stud socket 73 on the strap. FIG. 3 shows another football helmet chinstrap assembly 70' which includes two straps 72' in each strap set. Each strap 72' can carry a snap socket 73 via a corresponding slide carrier 74.

Each snap socket 73 is engaged with its snap stud by pushing the socket onto the stud until the socket "snaps" into place around the stud head to make the desired strap-to-helmet connection. That connection is unmade (released) by pulling on the strap end to pull the socket off the stud head.

Chinstrap assemblies 70 and 70', and others similar to them, present the problem which is addressed by the improved connectors described below and depicted in the following figures. As depicted, the connector assemblies utilize projections mounted to and extending from the exterior surfaces of football helmets; as a result, the receiver components of those connectors are depicted as being connected to (or connectible to) the free ends of straps of chinstrap assemblies. However, the receiver components of the improved connector assemblies can be mounted to the helmets, such as to inside surfaces of helmets under suitable padding. In that event, the projection components of the improved connector assemblies can be carried at the ends of the straps of chinstrap assemblies for cooperation with the receivers, such as through holes formed through the helmets; see, e.g., connector 110 depicted in FIG. 18.

Figures 4, 5, 6:
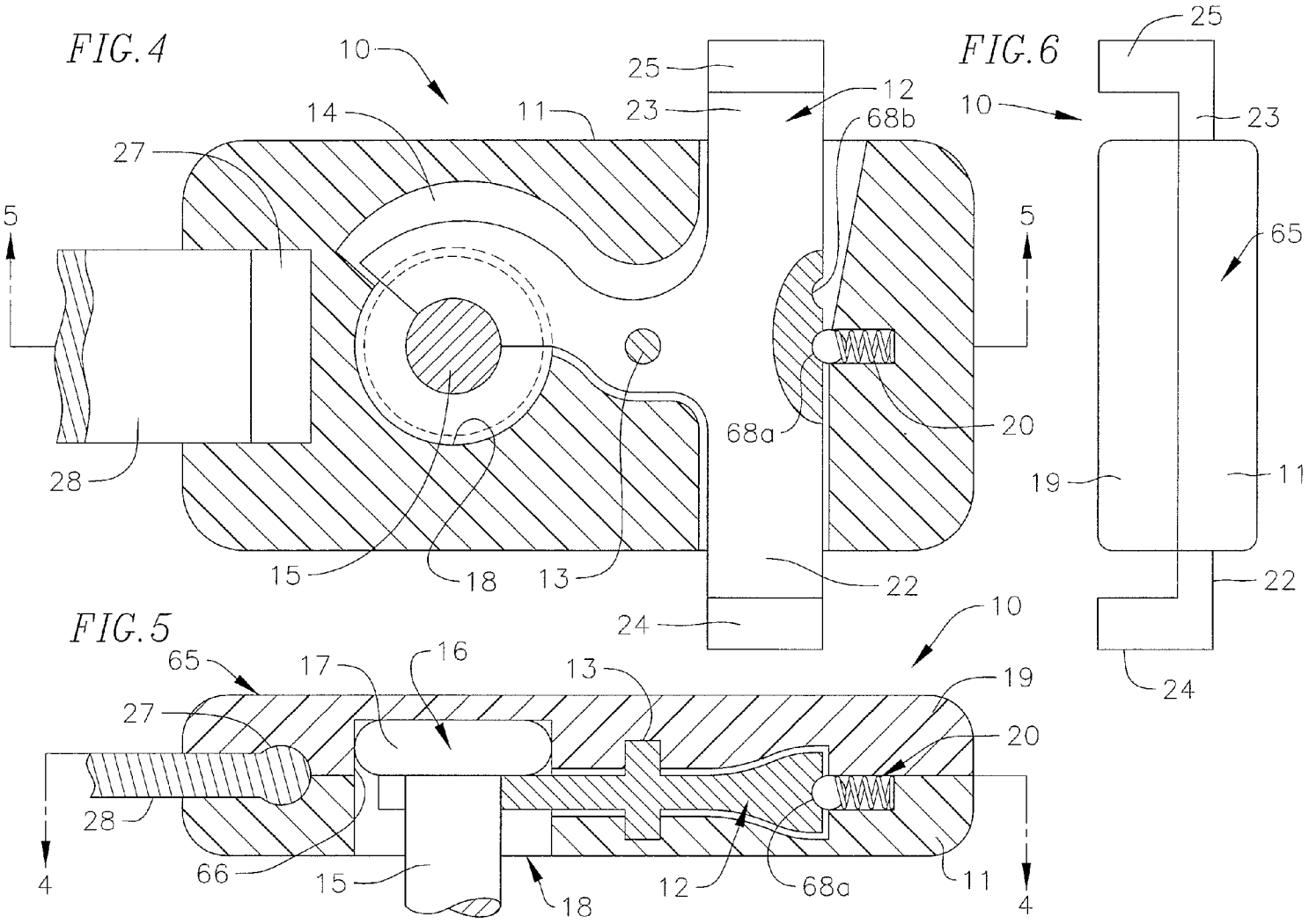
FIG. 4 is a cut-away view of a chinstrap connector according to an embodiment of the invention, taken along line 4-4 in FIG. 5.
FIG. 5 is a cross-sectional elevation view of the connector of FIG. 4, taken along line 5-5 in FIG. 4.
FIG. 6 is an end view of the connector of FIG. 4.

FIG. 5 is a longitudinal cross-sectional elevation view of a latching connector 10. The connector 10 is used to secure a chinstrap to a stud 16 of a helmet, and requires an affirmative action to release the chinstrap from the helmet. The connector 10 is attached to a strap 28 of a chinstrap, proximate the free end of the strap 28. The connector 10 includes a receiver or housing 65, and an actuator 12. The actuator 12 is movable within the housing 65 between a first position (shown in FIGS. 4 and 5) in which the actuator engages the stud 16 to secure the chinstrap to the helmet, and a second position in which the actuator disengages the stud to release the chinstrap from the helmet. An affirmative action by the user to move the actuator into the second position is required to release the connector 10 from the stud 16, thereby preventing inadvertent release of the chinstrap during recreational or sporting activities.

The details of the connector 10 will be described with reference to FIGS. 4-6. In this embodiment, the housing 65 is a two-part housing including a top piece 19 and a bottom piece 11. FIG. 4 is a plan view of the bottom piece 11 of the housing. An actuator 12 is movable about a pivot 13 in a recess 14 in the housing 65. The actuator 12 is shown engaged at its hook-like left end with the round stem 15 of the projecting helmet stud 16, below an enlarged head 17 of the stud, thereby to hold the stud captive in the connector receiver 65. The stud 16 extends through a hole or opening 18 in the underside of the bottom piece 11 of the housing, and extends into a cavity or receptacle 66 for the stud head 17. The opening 18 is sized to receive the stud into the housing. As shown in FIG. 5, the cavity 66 for the stud head 17 is formed in the lower surface of a housing top 19. The recess 14 for the actuator 12 is formed in the lower surface of the top 19 and in the upper surface of the housing bottom 11, which are facing each other.

The actuator 12 is held in its illustrated latched (engaged) position by cooperation of a spring-loaded ball detent 20 with a first recess 68*a* in the right end of the actuator. As shown in FIG. 4, the right end of the actuator defines oppositely extending lateral arms 22 and 23 in the basic plane of the actuator. The arms extend to the outside of the receiver housing 65 where they can form upwardly extending lugs 24 and 25 (shown in FIG. 6) by which a user operates the connector. To operate connector 10 from its depicted engaged state to its disengaged state relative to stud 16, a user pushes lug 25 to turn actuator 12 clockwise about its pivot 13, causing the left end of the actuator to move out from below the head 17 of the stud 16 so that the receiver housing 65 can be removed from the stud. The actuator can stay in its disengaged state because clockwise motion of the actuator causes a second detent recess 68*b* to move into alignment with the ball detent 20. The ball detent 20 thus retains the actuator 12 in the second, disengaged position (rotated clockwise about pivot 13 with respect to the first, engaged position).

The housing top and bottom parts 19, 11 and the actuator 12 can be molded of a suitable polymer material. The actuator and the ball detent parts can be positioned in recess 14 of the housing bottom 11 (as shown in FIG. 5), and then the housing top 19 can be mated to the housing bottom, trapping the actuator 12 inside the housing 65. The housing parts can secured together in any way desired, as by screws, by connection elements defined by them, or by solvent or sonic bonding. As the housing parts are assembled, a bulbed or enlarged end 27 of the strap component 28 of the chinstrap assembly, or of a flexible carrier for a strap coupling (see FIG. 17, e.g.), can be held captive between the mated housing parts, as shown in FIG. 5. This secures the connector 10 to the chinstrap assembly (or to the strap coupling shown in FIG. 17).

The connector 10 provides a safe and secure attachment of the chinstrap to the helmet, and is easy to operate. To secure the chinstrap to the helmet, the connector 10 is placed over the stud 16, with the stud entering the opening 18 in the underside of the housing 65, and the stud head 17 received into the cavity 66. The user then pushes on lug arm 24 and/or 25 to rotate the actuator 12 counter-clockwise about pivot 13 until the opposite end of the actuator moves under the head 17 of the stud. This is the first, engaged position of the actuator. In this position, the actuator extends between the enlarged head and the helmet, such that the enlarged head is held between the actuator and the housing, to retain the connector to the helmet. That is, the head 17 of the stud is trapped between the actuator and the housing 65, so that the head cannot be removed from the connector. As a result, the chinstrap is securely fastened to the helmet. The chinstrap cannot be dislodged simply by pulling on the strap or pulling the connector away from the stud, as the actuator holds the connector in place around the stud. The ball detent 20 rests in recess 68*a*, retaining the actuator in the first position. Additionally, the connector 10 and strap 28 can rotate about the stud 18, while remaining securely attached to the stud, in order to orient the strap 28 and chinstrap in a comfortable position for the user.

To remove the chinstrap, the user pushes on the lug arms 24 and/or 25 to rotate the actuator in the clockwise direction, into the second position. This rotation moves the end of the actuator out from under the head 17 of the stud, and the housing 65 can then be lifted off of the stud. The ball detent engages the second recess 68*b* to retain the actuator in the second position.

FIGS. 4 and 5 demonstrate the movement of the actuator relative to the housing 65 and the stud 16. The actuator moves in a plane that is generally perpendicular to the stud. For example, in FIG. 5, the stud extends up from the helmet in a vertical plane (in the orientation of FIG. 5), and the actuator moves in a horizontal plane, which is perpendicular to the vertical plane of the stud. The stud extends perpendicularly to the housing, extending up through the opening 18 into the housing 65, while the movement of the actuator is within the housing, perpendicular to the stud. This orientation enables the actuator to move to engage the stud.

Figure 7:
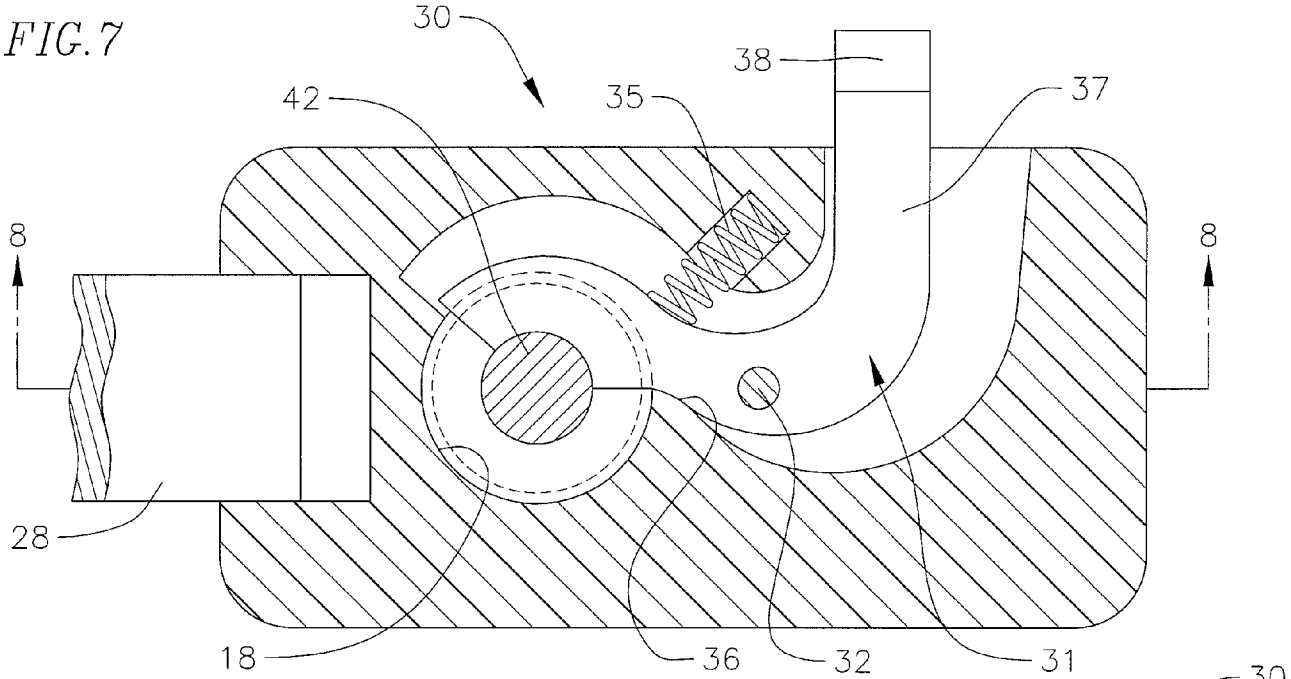
FIG. 7 is a cut-away view of a chinstrap connector according to an embodiment of the invention, taken along line 7-7 in FIG. 8.

A second connector 30 (shown in FIGS. 7 and 8) is similar to connector 10 in that it includes an actuator 31 pivoted at 32 between top and bottom receiver housing parts. The left end of actuator 31 is much like the left end of actuator 12 and cooperates in a latching manner with the stem 42 of a stud 33, below an enlarged head 34. A spring 35 is engaged in the actuator recess between the housing bottom and the actuator to bias the actuator counter-clockwise about its pivot 32, i.e., into the latching position of the actuator. The actuator cannot move counter-clockwise beyond its latching position because, in that position, the actuator contacts a stop 36 defined in a wall of the housing. The opposite end of the actuator defines an arm 37 which extends out the side of the receiver housing to a gripping portion such as a lug 38, by which a user can grip to rotate the actuator clockwise about pivot 32 adequately to move the left end of the actuator sufficiently clear of stud head 34 that the connector 30 can be lifted free of the stud. Once the receiver is clear of the stud, lug 38 can be released, enabling spring 35 to turn the actuator into its latching position. Thus, the actuator is biased into the first (engaged) position, and is not retained in the second (disengaged) position without a force applied by the user onto the lug 38.

Figure 8:
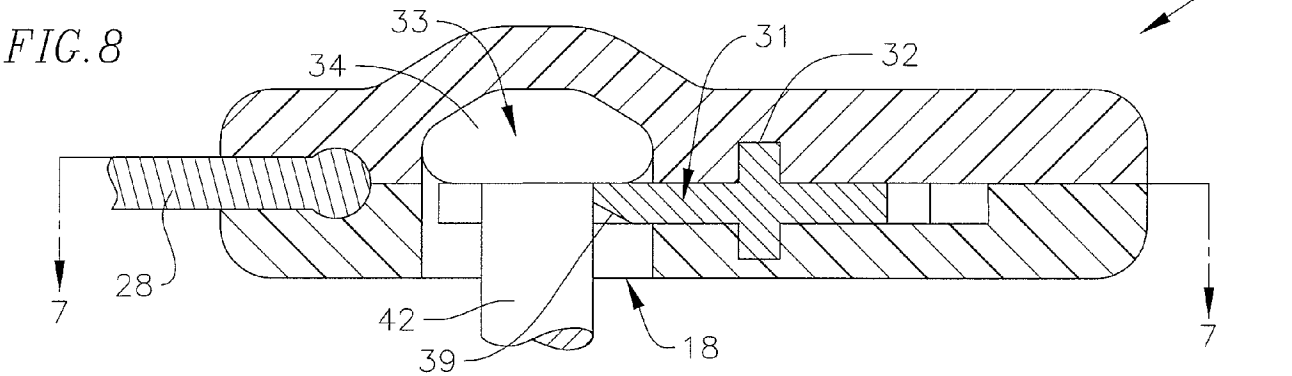
FIG. 8 is a cross-sectional elevation view of the connector of FIG. 7, taken along line 8-8 in FIG. 7.

In the embodiment of FIG. 8, the top of stud head 34 is conically tapered. The bottom side of the left end of actuator 31 can be relieved to define a downwardly facing sloping surface 39 around the arc of the actuator end which engages the stud stem 42. The tapered top of the stud head, and the slope 39 of the bottom surface of the actuator around its left end "hook" enables the receiver housing to engage with (and latch to) the stud 33 merely by centering the hole 18 over the stud and pushing the housing down on the stud. The tapered top surface of the stud head contacts the angled surface 39 of the actuator. As the user pushes down, the stud bears against the sloped surface 39 and forces the actuator to turn clockwise about pivot 32 until the stud head passes the actuator and moves into the recess in the housing, as shown in FIG. 8. Once the stud head has passed the actuator, the spring 35 forces the actuator to rotate in the opposite direction, rotating counterclockwise about pivot 32. This rotation moves the left end "hook" of the actuator into latching engagement with stud stem 42, below stud head 34. That is, to engage the connector 30 with a helmet stud 33, the connector is snapped into position on the stud, with the actuator snapping into position below the stud head. Removal of the receiver from the stud requires operation of the actuator at lug 38 as described above, to rotate the actuator away from the stud. This removal requires an affirmative action by the user to rotate the actuator. Simply pulling on the strap or the housing will not release the connector, as the stud is trapped between the housing and the actuator.

Figures 9, 10:
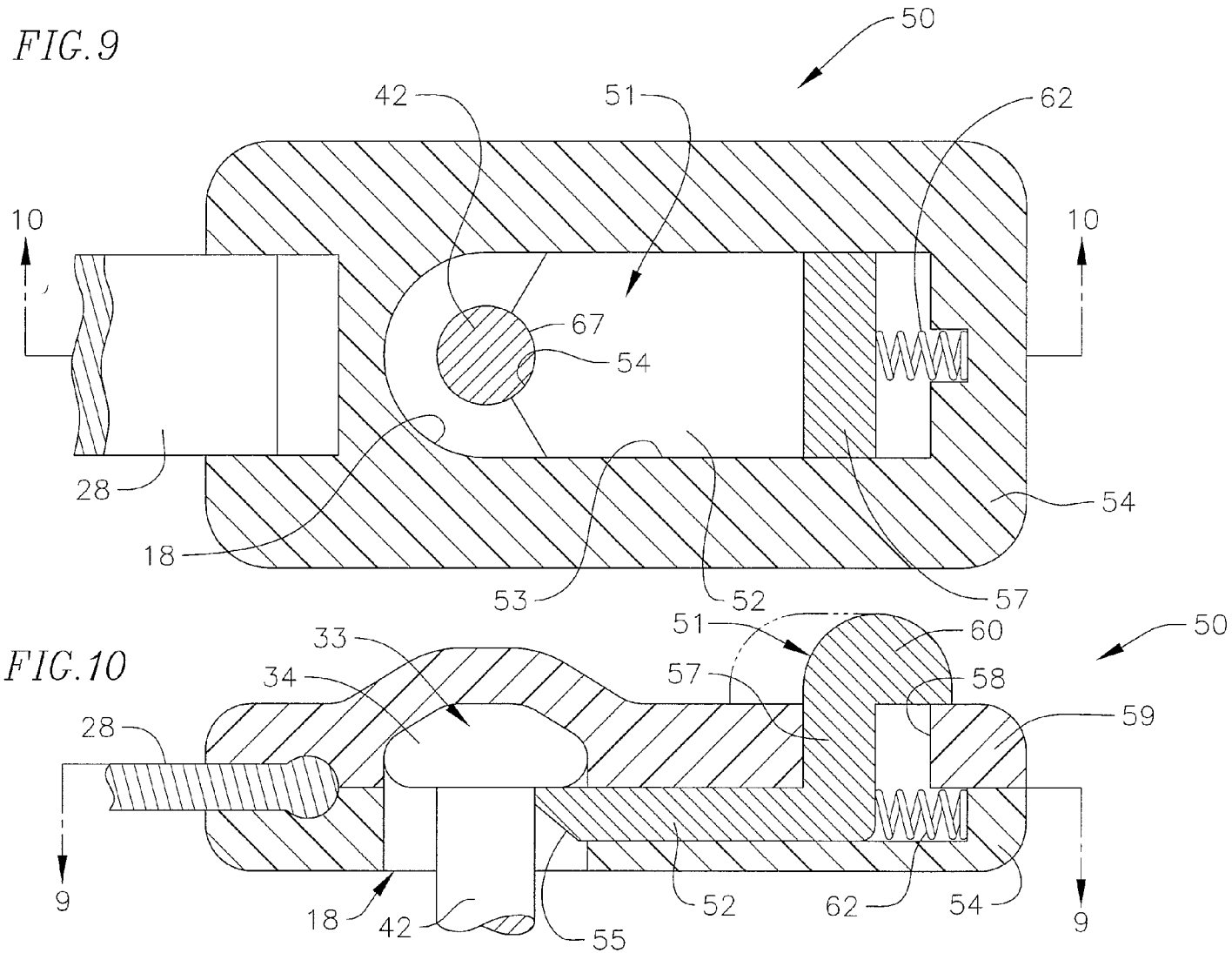
FIG. 9 is a cut-away view of a chinstrap connector according to an embodiment of the invention, taken along line 9-9 in FIG. 10.
FIG. 10 is a cross-sectional elevation view of the connector of FIG. 9, taken along line 10-10 in FIG. 9.

A connector 50 according to another embodiment of the invention is shown in FIGS. 9-10. Connector 50 cooperates with a stud 33 having a stem 42 and a head 34 with a tapered top. Connector 50 is similar to connector 30 in that it operates in a snap-on-to-latch and operate-to-disengage manner. However, the connector 50 includes a slide actuator 51 rather than a pivotable actuator. Slide actuator 51 has a horizontal body 52 which slides in a recess 53 in the top surface of receiver housing bottom 54. The permitted motion of actuator 51 in recess 53 is lateral movement toward and away from stud access hole 18. The left end of the slide body includes an arcuate notch 67 which mates with the stud stem 42 below the stud head, as shown in FIG. 9. The bottom edge of the slide end notch 67 is angularly relieved to define a downwardly facing sloping surface 55 (FIG. 10). At the opposite end, the actuator 51 includes a vertical leg 57 that extends from the body 52 upwardly to the exterior of the receiver housing through an elongate opening 58 formed through housing top 59. The upper end of leg 57 connects to an enlarged button 60 which can slide across the top surface of the housing. In one embodiment the button 60 is sized to be large enough to cover the opening 58 to the right of leg 57, when the actuator is in the engaged (left) position. The button can also be made large enough to cover the opening when the actuator has been moved to the disengaged (right) position (the larger button shown in dotted lines in FIG. 10). The bottom of leg 57 contacts a spring 62 which is mounted in the housing bottom 54 and which urges the actuator 51 into its latching position as shown. The actuator cannot move to the left beyond its latching position because a left face of the leg 57 then engages a left face of the opening 58. Also, if a stud is present, the notch 67 engages the stud.

To secure the chinstrap to the helmet, the connector 50 is snapped onto the stud. In particular, the housing of the connector is pushed down onto the stud so that the stud head 34 pushes against the sloped surface 55 and cams the slide actuator 51 away from the stud head against the bias of spring 62. The actuator 51 slides to the right (in FIG. 10) until the stud head clears the actuator. Once the stud head is above the actuator, the spring 62 pushes the actuator 51 and causes it to slide to the left (in FIG. 10) until the notched end 67 of the actuator moves under the head 34 of the stud. The notch 67 moves under stud head 34 to engage the stud stem as shown in FIG. 10. This is the first, engaged position of the actuator. To unlatch the connector 50 from the stud 33, a user pushes to the right on actuator button 60 to cause the actuator 51 to move to the right against the force of the spring 62, compressing the spring 62 until the notched end 67 of the slide actuator is clear of the stud head. The connector 50 can then be lifted off the stud before the user releases button 60. Once the connector 50 is clear of the stud, the user can release the button 60. The spring 62 will then return the actuator to the first position.

Thus, the connector 50 can be pushed directly onto the stud to securely connect the chinstrap, and then the button 60 is operated to release the connector from the helmet.

To enhance operation of connectors 30 and 50, e.g., it may be useful to form studs 33 and actuators 31 and 51 of polytetrafluoroethylene resin, due to the high lubricity of that resin. The tops and bottoms of the receivers of connectors 30 and 50 may be made of resins which are bondable to each other.

Figure 11:
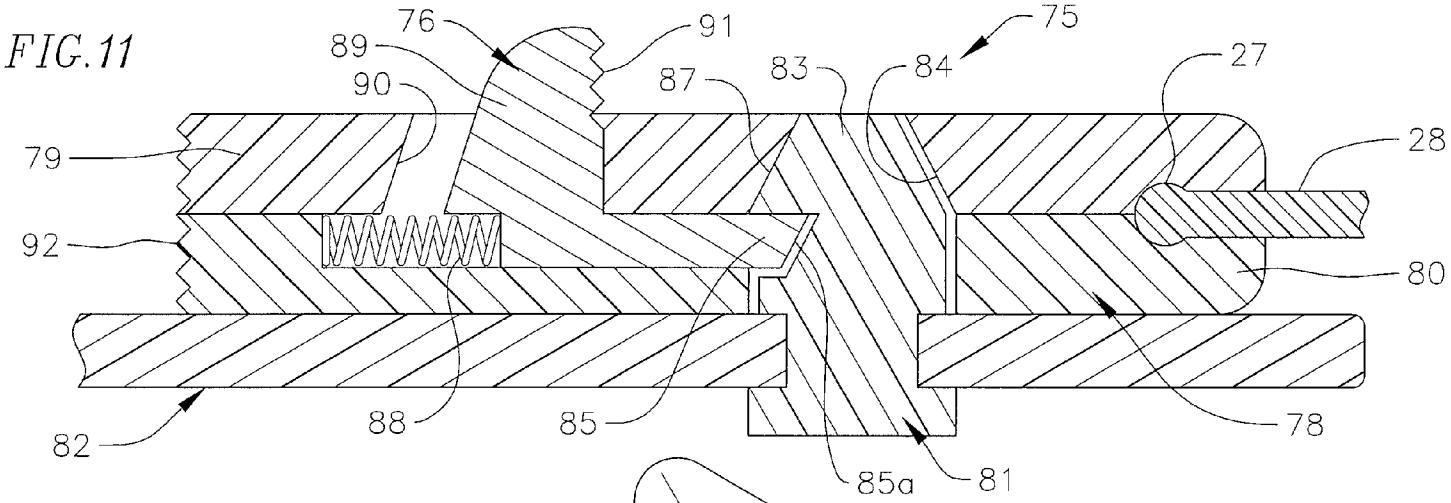
FIG. 11 is a cross-sectional elevation view of a chinstrap connector according to an embodiment of the invention.
Figure 12:
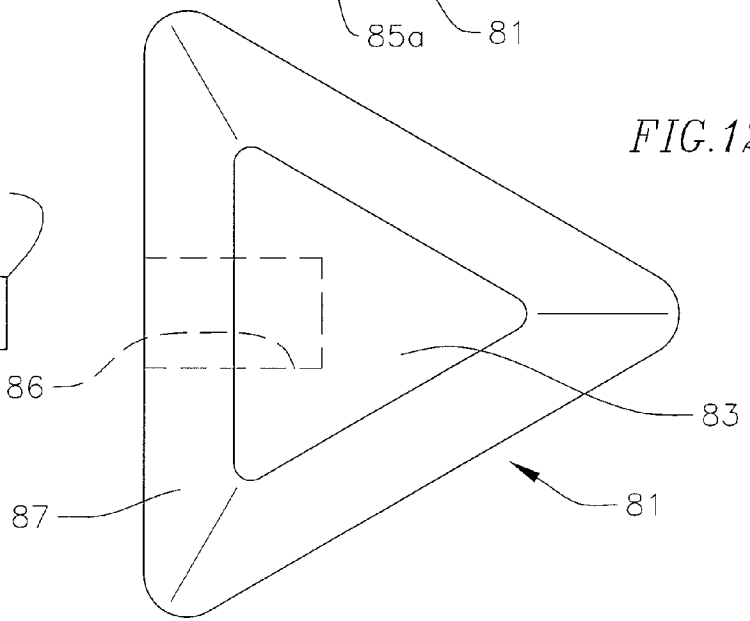
FIG. 12 is an enlarged plan view of a projection moiety of the connector shown in FIG. 11.
Figure 13:
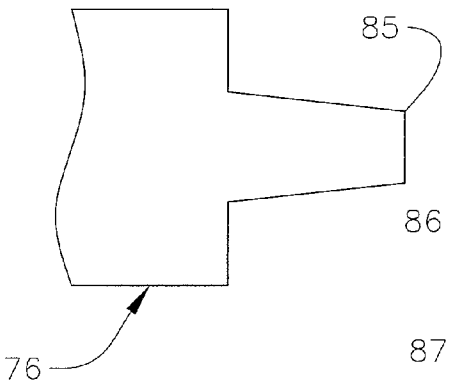
FIG. 13 is a partial plan view of an actuator which cooperates with the projection shown in FIGS. 11 and 12.

FIGS. 11-13 show aspects of a connector 75 according to another embodiment of the invention. The connector 75 includes a sliding actuator 76 movable inside a housing 78 having mating top 79 and bottom 80 parts configured to define a cavity between them in which the actuator is linearly movable. Housing 78 cooperates with a stud projection 81 suitably secured to a helmet 82. Stud 81 preferably has a non-round cross-sectional configuration in the portion of the stud which is outside the helmet, extending from the helmet to the outer end 83 of the stud 81. As shown in FIG. 12, the non-round cross-sectional shape of the stud can be triangular. Adjacent its outer end 83, which can be flat, the faces of the stud can be sloped (see FIG. 11) to cooperate with correspondingly sloped surfaces of a stud recess 84 formed by the top and bottom parts of the housing 78. The recess 84 has an opening through the receiver top part 79. The cooperating non-round contours of the stud 81 and the receptacle 84 orient the housing as it is placed over the stud. That is, these surfaces cause the housing to have a defined position angularly about the stud when the stud is fully mated with the housing as shown in FIG. 11.

The actuator 76 engages the stud 83 to retain the connector to the helmet. In the embodiment of FIGS. 11-13, the actuator 76 is slidable in the housing toward and away from the stud recess 84. The stud 83 has a face 87 that is oriented toward the actuator 76. This face 87 has a recess or opening 86 facing the actuator. The actuator has an end feature which extends into the recess 84 when the actuator is at its limit of motion toward the recess. That end feature of the actuator can be a finger or a pin 85 (FIG. 13) which moves into and out of the recess 86 (FIG. 12) in the face 87 of the stud. The stud face 87 can be sloped upwardly toward the axis of the stud beginning at a location on the stud which is at or below the upper edge of the recess 86. The end surface 85A of the actuator finger 85 preferably is similarly sloped as shown in FIG. 11. The stud face 87 and the finger end surface 85A form cooperating cam surfaces which contact, as the stud is moved into the recess 84. As the stud is moved upwardly into the recess 84, the end surface 85A moves over the facing surface 87, which cams the actuator away from the stud. This moves the actuator away from the stud against the force of an actuator bias spring 88 which is engaged between the receiver housing and the actuator. When the upper edge of the stud recess 86 has moved past the actuator finger 85, the spring 88 drives the actuator toward the stud to move finger 85 into the stud recess, thereby to releasably latch or lock the housing 78 onto the stud 81.

The actuator 76 can have a lateral lug 89 extending from the actuator body. The lug 89 can extend to the exterior of the receiver housing through an elongate opening 90 formed in the housing top part, as shown in FIG. 11. The lug and an end surface of the opening can cooperate to define the limit of motion of the actuator toward stud recess 84. The actuator lug 89 can have a grooved or otherwise suitably contoured surface 91 outside the housing to provide traction for a finger of a user. The user presses on the lug to slide the actuator away from the stud to release the connector from the helmet. An adjacent end surface of the housing can have a similarly grooved or contoured surface 92 for the user to squeeze the lug 89 toward the surface 92 to unlatch the connector 75, such as with a thumb and forefinger.

Figure 14:
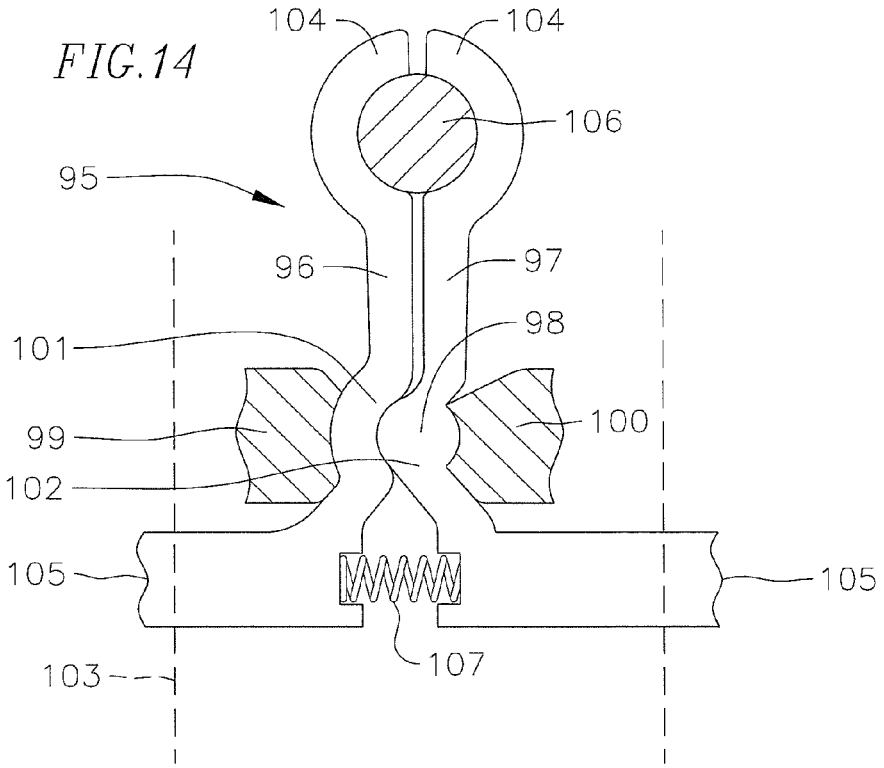
FIG. 14 is a partial cross-sectional view of a latch mechanism according to an embodiment of the invention.

Connectors 10 and 30, described above, include actuators of the single pivot arm type which cooperate with studs having enlarged heads. In another embodiment, a connector according to this invention can include two pivot arms in its stud latching mechanism. An exemplary two pivot arm latch mechanism 95 is depicted in FIG. 14 in which two pivot arms 96 and 97 are pivotable about a common pivot point 98. The arms 96 and 97 can pivot relative to each other at hubs 101 and 102 and relative to locating features 99 and 100 of a receiver housing 103 due to circularly cylindrical mating surfaces between them concentric to the common pivot point 98. Hubs 101 and 102 are located on arms 96 and 97 between opposing arcuate arm ends 104 and opposing arm operating ends 105. The arcuate arm ends 104 are curved to mate with a stud stem 106 below an enlarged head of the stud. The operating arm ends 105 extend outside the housing and can be moved toward each other by a user, to release the arcuate ends 104 from the stud 106. The operating arm ends 105 can be squeezed together against the action of a bias spring 107, which urges the arm ends 105 away from each other, thus urging the arm ends 104 toward each other. To release the arms 104 from the stud, the user squeezes the arm ends 105 toward each other. Lower surfaces of arm ends 104 can be relieved and the stud head can be tapered similarly to the depiction of FIG. 8 so that axial motion of the stud toward the arm ends 104 can spread the arms to enable the stud head to pass; again, refer to FIG. 8 and the related description. Accordingly, a connector may be arranged with two arms engaging the helmet stud.

In various embodiments of the invention, the stud is carried by the helmet, and the connector is carried by the strap. In one embodiment, the stud is rigidly mounted in the helmet, and the stud is not movable. The stud is fixedly mounted to the helmet to provide a secure point of attachment for the connector. The connector is carried by the strap, and the actuator in the connector engages the rigid stud to secure the strap to the helmet. However, in other embodiments, the stud is carried by the strap, and the connector is mounted to the helmet. In this case, the stud is inserted into an opening or recess in the helmet, and an actuator in the helmet is moved into the engaged position. An example of this embodiment is shown in FIG. 18.

Figure 18:
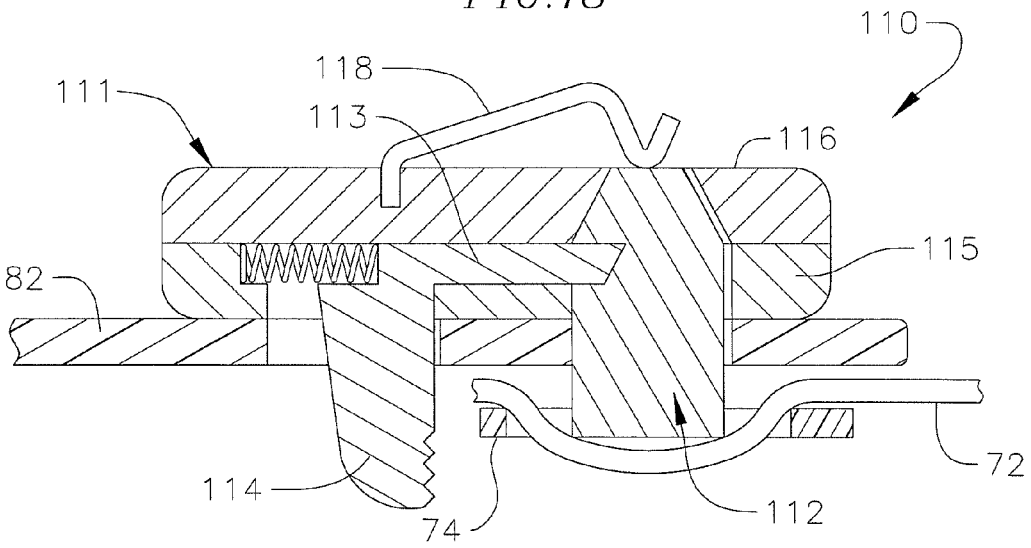
FIG. 18 is a cross-sectional view of a connector located inside a helmet, according to an embodiment of the invention.

A connector 110 according to another embodiment of the invention is shown in FIG. 18. In this embodiment, the connector 110 is provided inside of a helmet 82, and a stud 112 is carried on the end of a strap 72. For example, the connector 75 (of FIG. 11) can be modified into this form. The connector 110 is mounted inside the helmet 82. The stud 112 is connected to an end of a strap 72 of a chinstrap assembly, e.g., via a slide carrier 74 which carries the stud. The stud 112 can be very similar to stud 81. The connector 110 includes a housing 111 and an actuator 113 slidable within the housing between top and bottom parts 115, 116 of the housing. The stud 112 includes a recess that is engaged by a finger extending from the actuator 113. The bottom part 115 of the housing and the helmet 82 have aligned openings that allow an operating lug 114 of the actuator to pass through the openings to the exterior of the helmet. The opening in the helmet for this lug 114 may be proximate or adjacent a separate opening for receiving the stud 112. An actuator bias spring 118 is engaged between the housing 111 and the actuator 113 to urge the actuator toward the stud 112. The strap 72 is connected to the helmet by pushing the non-round stud 112 into the stud receptacle to cause the actuator finger to latch to the stud recess in the manner described above concerning connector 75. Such a connection can be released by moving the finger out of the stud recess by use of actuator operating lug 114.

FIG. 18 shows that a connector according to an embodiment of this invention can be arranged to cause the stud to urge against a release spring when the stud is inserted into the connector. The last increment of motion of the stud into the connector pushes against the action of the stud release spring. As shown in FIG. 18, the connector 110 includes a stud release spring in the form of a leaf spring 118 that has one end fixed to the housing 111 and its other movable end positioned to engage and be deflected by the end of stud 112 as the stud approaches and reaches its engaged position in the connector. The spring 118 acts on an engaged stud to load the stud against the actuator, and to drive the stud partially out of the stud receptacle as soon as the actuator finger moves out of the stud recess. Thus, when the user operates the lug 114 to release the stud, the spring 118 pushes the stud away from the helmet. A user of the helmet can then easily fully extract the stud from the stud receptacle if that is desired.

Figure 15:
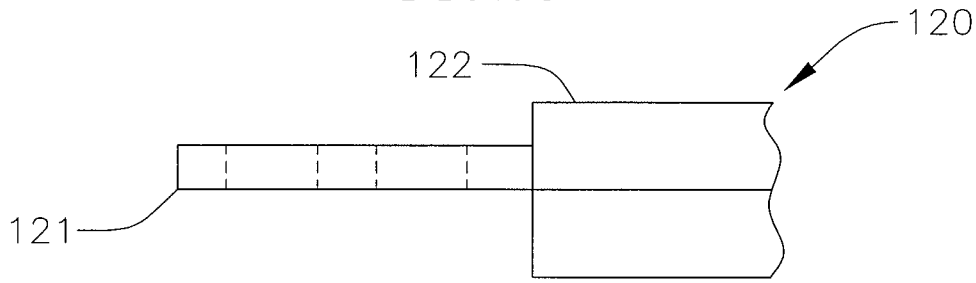
FIG. 15 is a partial elevation view of an end of a connector having an external strap coupling arrangement, according to an embodiment of the invention.
Figure 16:
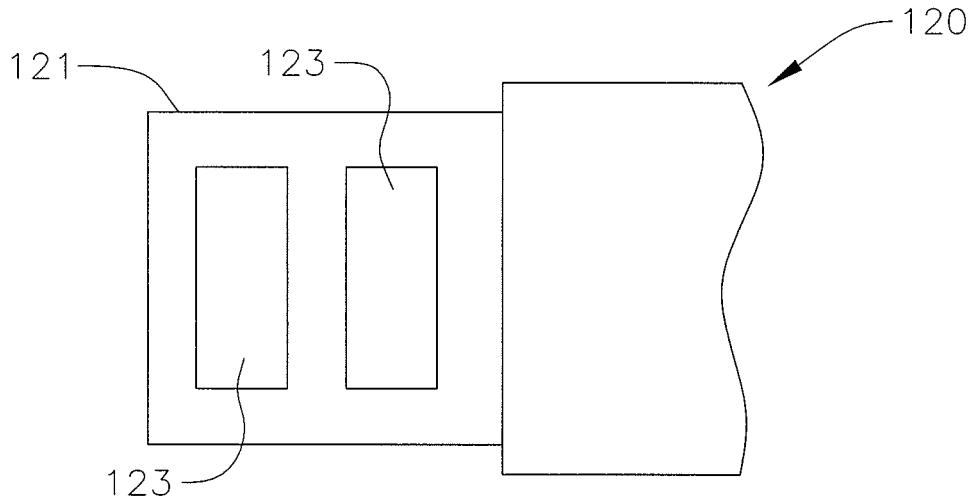
FIG. 16 is a plan view of the structure shown in FIG. 15.
Figure 17:
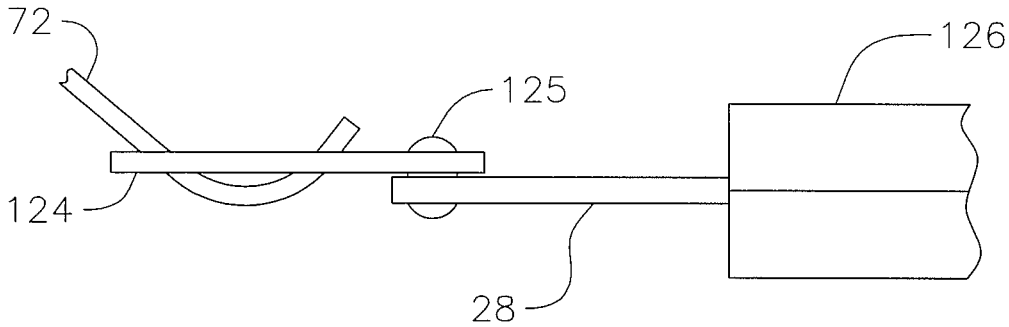
FIG. 17 is a partial elevation view showing a connector connected to a chinstrap assembly, according to an embodiment of the invention.

If the receiver moiety of a connector according to an embodiment of this invention is to be used with a stud carried by a helmet, the connector receiver is suitably connected to a strap of a chinstrap assembly. As shown in FIGS. 15 and 16, in one embodiment, a receiver or housing 120 of a connector has a strap coupler 121 formed integrally with one of the housing parts, such as upper housing part 122. The strap coupler defines two adjacent parallel elongate openings 123 through which a strap end can be passed. Alternatively, as shown in FIG. 17, a slide carrier element 124 can be connected, as by a rivet 125, to the end of a flexible tab 28 which can be secured to the connector receiver 126 in the manner shown at 27 in FIGS. 4 and 5, as an example.

Situations may arise where the wearer of a helmet may desire at certain times to secure the chinstrap to the helmet by use of a conventional snap connection of the chinstrap to the helmet, and also may desire at other times to have a more secure connection of the chinstrap to the helmet. Latchable snap connector 130, shown in FIGS. 19 and 20 affords those choices to a user of a helmet equipped with such a connector.

Figure 20:
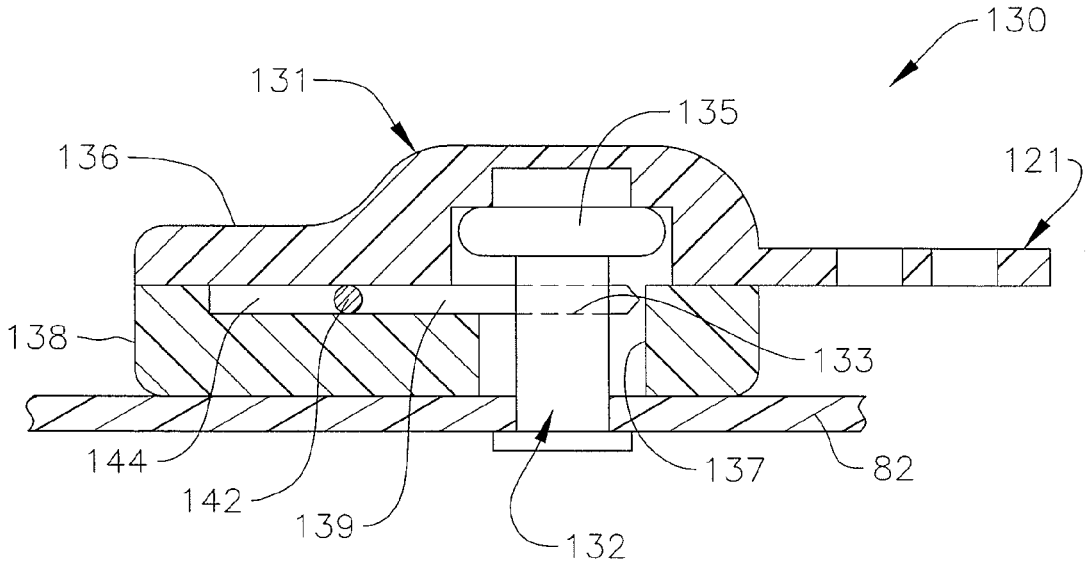
FIG. 20 is a cross-sectional elevation view of the connector shown in FIG. 19.

The connector 130 has a receiver component 131 and a projection component 132. The receiver 131 can be connected to an end of a strap of a chinstrap assembly, such as via a strap coupler 121 (see also FIGS. 15-17) connected to the receiver. The projection component 132, in this instance, preferably, is a snap stud projecting from an exterior surface of a helmet 82. The helmet has an outer shell, and the stud extends past the outer shell, so that the stud is accessible from the exterior of the helmet. The stem of the snap stud, at a location outside the helmet and below the head of the stud, can have a hole 133 through the stem or a recess (not shown) partially through the stem. A snap socket 135 can be carried in an upper part 136 of the receiver 131 for releasable cooperation with the head of stud 132 as shown in FIG. 20. A stud access hole 137 can be provided through a lower part 138 of the receiver in alignment with the snap socket. Connector 130 can be used as an unlatched snap connector by engaging and disengaging the connector snap socket and stud components in the conventional manner.

However, connector 130 includes an actuator which can be engaged with the snap stud in a latching manner to hold the receiver on the snap stud when the actuator is in a latching position within the receiver. The actuator can be provided as a stiff wire or small diameter rod 139 an end 140 of which is sized to be engagable in stud stem hole 133 as shown in FIGS.

19 and 20 to latch the receiver to stud 132. Rod 139 can be movable toward and away from stud access hole 137 in a guide passage formed, e.g., in the interface between receiver parts 136 and 138. At its end away from the stud access hole, the actuator rod 139 can have lateral extensions 142 which are located in a passage 144 transversely through the receiver and which are of such length that their ends are outside the sides of the receiver where they can mount buttons 143 by which a user can apply forces to the actuator to move the actuator linearly within the receiver. Passage 144 has opposite walls 145 and 146 which define the limits of motion of the actuator rod into and out of latching relation with stud 132. The range of linear motion afforded to rod 139 is sufficient to enable rod end 140 to be moved out of stud access hole 137 so that the head of the stud can move freely into and out of the hold as the stud head is moved into and out of engagement with snap socket 135.

Figure 19:
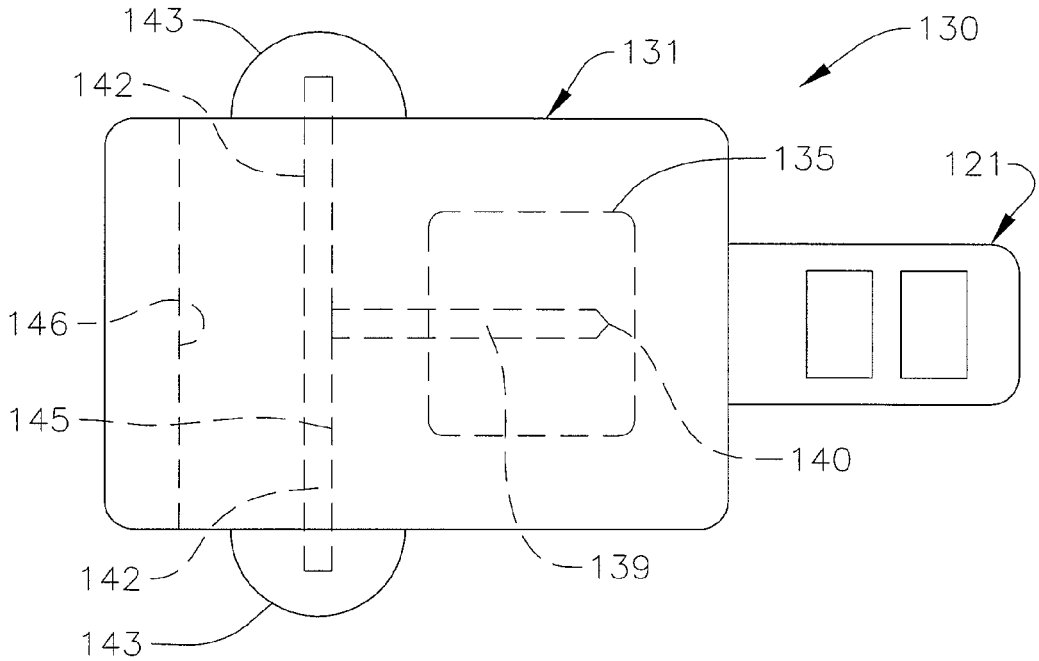
FIG. 19 is a top plan view of a connector with a non-round snap socket, according to an embodiment of the invention.

Alignment of actuator rod 139 with stud stem hole 133, required to enable a retracted rod to be moved into latching engagement in hole 133, is obtained by making the stud head of non-round shape and by making snap socket of cooperating non-round configuration. A square snap socket 135 is depicted in FIG. 19; other stud head and snap socket geometries can be used to assure that the receiver has the desired angular relation to the snap stud when the receiver is snapped onto the stud.

The fit of actuator rod 139 in its guide passage within the receiver can be a snug slidable fit providing sufficient friction to hold the actuator in its latching and disengaged positions in the receiver. If desired, a spring (not shown), such as a leaf spring acting laterally on the actuator rod in its guide passage, can be used to provide position-holding force on the rod.

Figure 21:
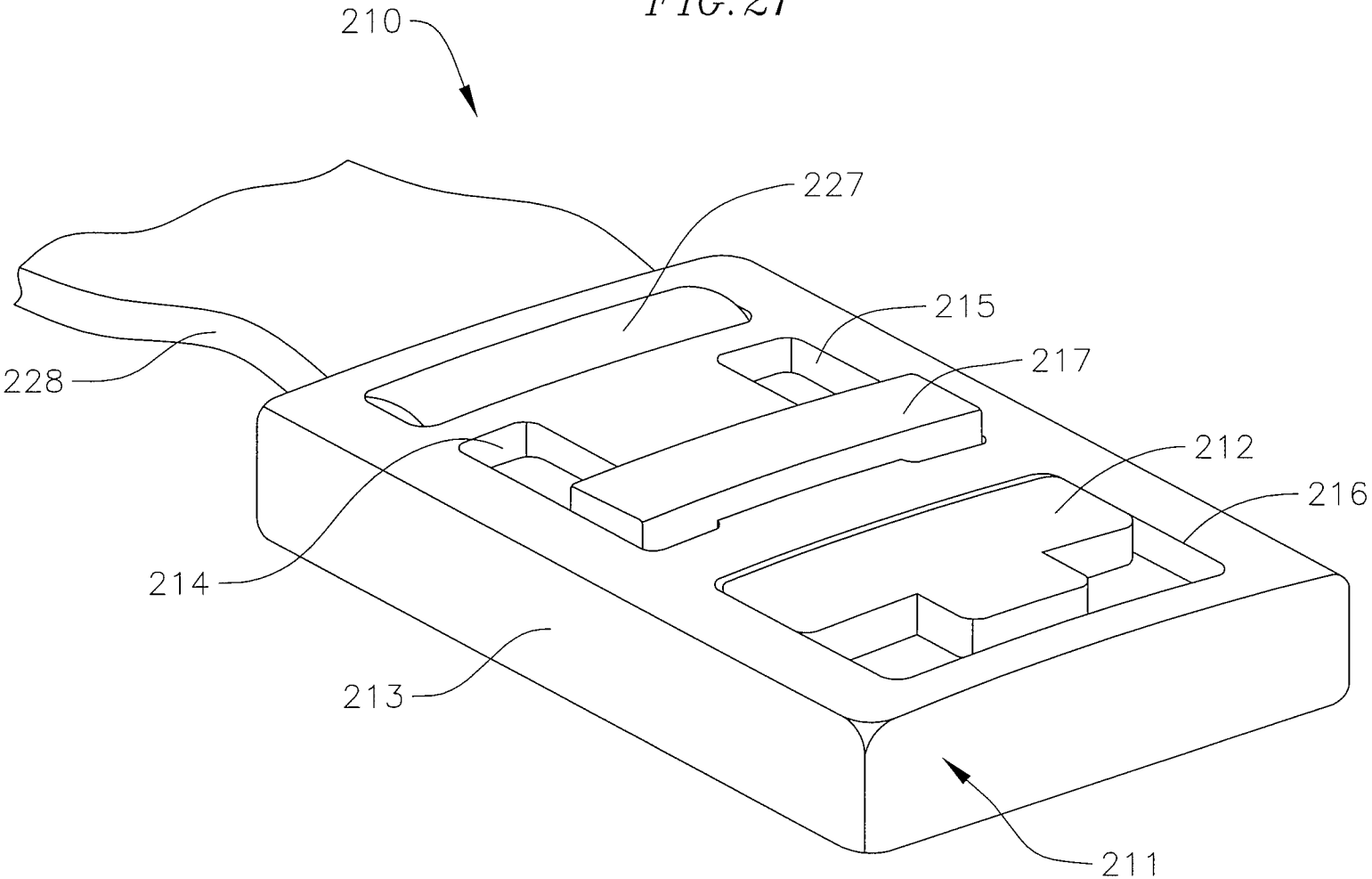
FIG. 21 is a perspective view of a chinstrap connector and strap, according to an embodiment of the invention.

A connector 210 according to another embodiment of the invention is shown in FIG. 21. The connector 210 includes a housing 211 that can be formed integrally out of one piece of material, rather than two separate top and bottom housing pieces. The connector also includes an actuator 212 that slides back and forth with respect to the housing 211 to engage and disengage a helmet stud (not shown). The housing 211 includes an opening 216 for receiving the stud, and a generally hollow underside enclosed by side walls 213. The actuator 212 slides back and forth along the hollow underside of the housing. The actuator 212 is retained to the housing by passing through two slots 214, 215. A raised end portion 217 of the actuator extends above the housing for easy operation by the user. The user can push on the raised portion 217 to move the actuator into the first, engaged position with the stud, or into the second, disengaged position away from the stud. In either position, the actuator remains in place due to the frictional engagement of the actuator with the walls of the housing 211. The actuator can be formed from a polymer material such as a stiff rubber that provides friction along the housing but also firmly retains the stud in the opening 216. The stud includes a shoulder or step facing the actuator, and the actuator engages the stud by engaging the step. The step may take the form of an enlarged head, with the actuator extending under the enlarged head, or it may take the form of an opening or recess in the stud, with the actuator extending into this opening or recess. At one end of the housing, a strap 228 with strap end 227 is connected to the housing 211.

The functions described above can be attained or performed in connectors according to this invention by features, structures or devices different from those depicted and described. For example, connectors 10, 30 and 50 can be adapted for mounting inside a helmet by extending their operating lugs in opposite directions relative to the stud receptacles so that the operating lugs can project through suitable openings in the helmet. Further, by way of example, receiver actuator bias springs can be leaf springs, torsion springs, or tension springs, rather than the compression springs which have been depicted. Still further, the functions of the depicted stud release spring 118 can be performed by compression springs mounted in closed ends of the stud receptacles.

Although the present invention has been described and illustrated in respect to exemplary embodiments, it is to be understood that it is not to be so limited, since changes and modifications may be made therein which are within the full intended scope of this invention as hereinafter claimed.

What is claimed is:

1. A helmet assembly comprising:
- a helmet comprising a stud projecting from the exterior of the helmet along a stud axis;
- a chinstrap comprising a strap; and
- a connector attached to the strap, the connector comprising:
  - a housing having an underside with an opening sized to receive the stud axially through the opening into the housing, and
  - an actuator movable within the housing between a first position in which the actuator engages the stud to retain the connector to the helmet and a second position in which the actuator disengages the stud to release the connector from the helmet,
  - wherein the actuator comprises a gripping portion extending outside the housing for operation by a user to move the actuator between the first and second positions;
  - wherein the actuator comprises a first portion and an opposing second portion that form a collar to engage the stud;
  - wherein both the first portion and the second portion are configured to move when the actuator is moved between the first position and the second position;
  - wherein the connector is positioned on the helmet to enable the chinstrap to engage the chin of a user; and
  - wherein the helmet is subject to potential repeated impact while worn by the user.

2. The helmet assembly of claim 1, further comprising a spring between the actuator and the housing, the spring biasing the actuator into the first position.

3. The helmet assembly of claim 1, wherein the stud comprises an enlarged head, and wherein the actuator extends in its first position between the enlarged head and the helmet, such that the enlarged head is held between the actuator and the housing to retain the connector to the helmet.

4. The helmet assembly of claim 3, wherein the enlarged head of the stud comprises a tapered top surface, and wherein the actuator comprises a sloped bottom surface, the tapered top surface engaging the sloped bottom surface when the stud is inserted into the housing, the sloped surfaces being so arranged that forceful contact between them urges the actuator toward its second position.

5. The helmet assembly of claim 1, wherein the stud comprises a recess, and wherein the actuator comprises a protrusion dimensioned to extend into the recess when the actuator is in the first position, to retain the connector to the stud.

6. The helmet assembly of claim 1, wherein the gripping portion comprises a lug projecting from the housing for operation by a user.

7. The helmet assembly of claim 1, wherein the housing comprises first and second mating pieces, the actuator being located between the first and second mating pieces of the housing.

8. The helmet assembly of claim 1, wherein the actuator rotates between the first and second positions about a pivot point.

9. The helmet assembly of claim 1, wherein the actuator slides between the first and second positions.

10. The helmet assembly of claim 1, wherein the stud comprises a step, and wherein the actuator comprises a portion that extends under the step when the actuator is in the first position.

11. The helmet assembly of claim 1, wherein the housing comprises a top side opposite the underside, and comprises an opening in the top side, and wherein the gripping portion of the actuator extends through the opening in the top side for operation by a user.

12. The helmet assembly of claim 11, wherein the actuator covers the opening in the top side when the actuator is in the first position.

13. The helmet assembly of claim 1, wherein the stud extends outwardly from the helmet in a first plane, and wherein movement of the actuator from the first position to the second position is in a second plane generally perpendicular to the first plane.

14. A helmet assembly comprising:

a helmet;

a chinstrap comprising a strap for securing the chinstrap to the helmet;

a stud; and a connector, wherein the stud is carried in a projecting manner by one of the helmet or the strap, and wherein the connector is carried by the other of the helmet or the strap, wherein the connector comprises a housing and an actuator, the housing comprising an opening sized to receive the stud, wherein the actuator is movable within the housing between a first position in which the actuator engages the stud to retain the chinstrap to the helmet and a second position in which the actuator disengages the stud to release the chinstrap from the helmet, wherein the actuator comprises a gripping portion extending outside of the housing to be accessible to a person wearing the helmet, the gripping portion being operable by such person to move the actuator with respect to the housing;

wherein the actuator comprises a first portion and an opposing second portion that form a collar to engage the stud;

wherein both the first portion and the second portion are configured to move when the actuator is moved between the first position and the second position;

wherein the connector is positioned on the helmet to enable the chinstrap to engage the chin of a user; and wherein the helmet is subject to potential repeated impact while worn by the user.

15. The chinstrap assembly of claim 14, wherein the connector is carried by the strap and the stud is carried by the helmet.

16. The chinstrap assembly of claim 14, wherein the connector is carried by the helmet and the stud is carried by the strap.

17. A helmet assembly, comprising:

a helmet having an outer shell and a stud extending outwardly from the outer shell, the stud having an enlarged head;

a chinstrap; and a connector attached to the chinstrap and configured to releasably attach to the stud to retain the chinstrap to the helmet, the connector comprising:

a housing comprising a recess and an underside with an opening into which the stud head can be received; and an actuator movable within the recess between a first position in which the actuator engages the stud as received in the opening to retain the connector to the helmet and a second position in which the actuator disengages the stud to release the connector from the helmet, wherein the actuator comprises an extension that extends under the enlarged head of the stud when the actuator is in the first position, trapping the enlarged head between the extension and the housing, wherein the actuator further comprises a lug extending outside of the housing, for operation by a user, to move the actuator between the first and second positions, wherein the stud extends outwardly from the helmet in a first plane, and wherein movement of the actuator from the first position to the second position is in a second plane generally perpendicular to the first plane; and wherein the connector is positioned on the helmet to enable the chinstrap to engage the chin of a user; and wherein the helmet is subject to repeated impact while worn by the user.

18. A helmet assembly comprising:

a helmet;

a chinstrap comprising a strap for securing the chinstrap to the helmet;

a stud; and a connector, wherein the stud is carried in a projecting manner by one of the helmet or the strap, and wherein the connector is carried by the other of the helmet or the strap, wherein the connector comprises a housing and an actuator, the housing comprising an opening sized to receive the stud, wherein the actuator is movable within the housing between a first position in which the actuator engages the stud to retain the chinstrap to the helmet and a second position in which the actuator disengages the stud to release the chinstrap from the helmet, wherein the actuator comprises a gripping portion extending outside of the housing to be accessible to a person wearing the helmet, the gripping portion being operable by such person to move the actuator with respect to the housing;

wherein the stud has an engaged position in the connector related to the first position of the actuator, and including a resilient element in the helmet which is operative on the stud in its engaged position to urge the stud to move out of the connector opening; and wherein the connector is positioned on the helmet to enable the chinstrap to engage the chin of a user.

19. Apparatus useful for releasably connecting a chinstrap to a helmet, comprising:

an elongate stud adapted to be secured to one of a helmet or a chinstrap for a helmet, to project therefrom, a housing adapted to be secured to the other one of the helmet or the chinstrap, the housing providing an opening arranged to receive the projecting end of the stud, at least one stud retainer member mounted in the housing for movement between a first position in which the retainer member engages a stud received in the opening and a second position in which a received stud can be removed from the opening, a resistant bias effective between the housing and the stud retainer to urge the stud retainer into its first position, the stud retainer having an element connected to it which extends outside the housing in the first position of the stud retainer and which is engageable by a wearer of the helmet to move the stud retainer to its second position;

wherein the stud retainer includes a pair of oppositely disposed portions that collar the projecting end of the stud between the helmet and head of the stud;

wherein the actuator in the second position is operable to move both portions of the stud retainer away from one another;

wherein the connector is positioned on the helmet to enable the chinstrap to engage the chin of a user; and wherein the helmet is subject to repeated impact while worn by the user.

* * * * *